United States Patent [19]

Hamano et al.

[11] Patent Number: 4,543,923

[45] Date of Patent: Oct. 1, 1985

[54] ENGINE STARTER

[75] Inventors: Isao Hamano; Kiyoshi Yabunaka; Yoshifumi Akae; Toshinori Tanaka; Takeo Gotou, all of Himeji; Kouichi Matsumoto, Tatsuno, all of Japan

[73] Assignee: Mitsubishi Denki Kabushiki Kaisha, Tokyo, Japan

[21] Appl. No.: 552,840

[22] Filed: Nov. 17, 1983

[30] Foreign Application Priority Data

Dec. 3, 1982 [JP] Japan ..... 57-183899[U]

[51] Int. Cl.[4] ..... F02N 7/00; F02N 11/00; F02N 15/02

[52] U.S. Cl. ..... 123/179 F; 123/179 M; 74/6

[58] Field of Search ..... 123/179 F, 179 M, 179 E; 74/7 C, 6

[56] References Cited

U.S. PATENT DOCUMENTS

| | | | |
|---|---|---|---|
| 973,232 | 10/1910 | Stryker | 74/6 |
| 1,124,736 | 1/1915 | Heany | 123/179 F |
| 1,196,156 | 8/1916 | Savidge | 123/179 F |
| 1,364,853 | 1/1921 | Hartford et al. | 123/179 M |
| 4,235,216 | 11/1980 | Miles | 123/179 F |
| 4,347,813 | 9/1982 | Maucher et al. | 123/179 M |

*Primary Examiner*—Andrew M. Dolinar
*Attorney, Agent, or Firm*—Oblon, Fisher, Spivak, McClelland & Maier

[57] ABSTRACT

An engine starter comprises a d.c. motor, a pinion secured to one end of the rotary shaft of the d.c. motor, a rotary flange having a ring gear which is always interlocked with the pinion to be driven, a flywheel which is on one hand, connected to the rotary flange through rotational force one-way coupling clutch and is, on the other hand, firmly secured to the crank shaft of the engine, an air motor connected to the other end of the rotary shaft of the d.c. motor and an air tank communicated to the air motor through a piping, an electromagnetic valve being interposed in the piping.

4 Claims, 2 Drawing Figures

ENGINE STARTER

BACKGROUND OF THE INVENTION

The present invention relates to an improvement in an engine starter.

As a general type of a starter mounted on a small-sized engine, there has so far been known such one as shown in FIG. 1.

In FIG. 1, a crank shaft 2 extends from an internal combustion engine 1 (hereinafter referred to as an engine) and a flywheel 4 with a ring gear 3 fitted at its outer circumference is secured at the free end of the crank shaft 2. A starter motor indicated, as a whole, by a reference nuemral 5 is constituted by a d.c. motor 6, an overrunning clutch 7 and the rotary shaft 8 of the d.c. motor 6. The overrunning clutch 7, provided with a lever-engaging slot 7*a*, has a spline-connection with the rotary shaft 8 in a slidable manner in the axial direction. A pinion 10 is secured to the output rotary shaft 9 so as to be capable of interlocking with the ring gear 3. A shift lever 11 has a pivotal point 11*a* supported by a frame (not shown), a lower end part inserted into the lever-engaging slot 7*a* of the overrunning clutch 7 to be engaged therewith, and an upper end part inserted into the plunger 13 of an electromagnetic switch 12 to be engaged therewith.

In the engine starter having the structure as above-mentioned, when the electromagnetic switch 12 is actuated by feeding current, the plunger 13 is attracted into a casing (not shown) with the consequence that the shift lever 11 is forced to turn in the clockwise direction in the figure around the pivotal point 11*a* to urge the overrunning clutch 7 on and along the rotary shaft 8 forwardly in the state as shown in FIG. 1, namely toward the left side in FIG. 1 whereby the pinion 10 is brought to interlocking with the ring gear 3. As soon as the pinion 10 interlocks with the ring gear 3, a main contact (not shown) of the electromagnetic clutch 12 is closed to cause the d.c. motor 6 to generate torque. The torque of the d.c. motor is transmitted to the ring gear 3 through the rotary shaft 8, the overrunning clutch 7, the output rotary shaft 9 and the pinion in this order, with the result that the crank shaft 2 is actuated to be driven and the engine 1 is started. After starting of the engine 1, the actuation of the electromagnetic switch 12 is removed by breaking the current. Then, the plunger 13 returns to the state as shown in FIG. 1 by the repulsive force of a spring (not shown) which is housed in the casing of the electromagnetic switch 12 and the shift lever 11 moves the overrunning clutch 7 backward (on the right hand in FIG. 1) along the rotary shaft 8 to disconnect the pinion 10 from the ring gear 3 thereby returning it into a standing condition as shown in FIG. 1.

Thus, since the conventional device is constructed in such a manner that the d.c. motor 6 is actuated by feeding a relatively large current from a battery (not shown) mounted on a car for each time of starting the engine 1, excessive discharge is caused in the car battery when start and stop of the engine 1 is repeated during a short time thereby inviting a rapid reduction in the starting function of the engine. Further, when the engine is restarted immediately after its stoppage, the resistance of a circuit becomes large due to a high temperature around the starting system whereby the engine sometimes could not be started.

SUMMARY OF THE INVENTION

It is an object of the present invention to overcome the disadvantages of the conventional device and to provide an engine starter in which an air motor to be actuated by feeding air is connected to a d.c. motor to thereby be capable of starting with a high power at the time of the restart of an engine.

According to the present invention, there is provided an engine starter comprising a d.c. motor, a pinion secured to one end of the rotary shaft of the d.c. motor, a rotary flange having a ring gear which is always interlocked with the pinion to be driven, a flywheel which is, on one hand, connected to the rotary flange through a rotational force one-way coupling clutch and is, on the other hand, firmly secured to the crank shaft of the engine, an air motor connected to the other end of the rotary shaft of the d.c. motor and an air tank communicated to the air motor through a piping, an electromagnetic valve being interposed in the piping.

The foregoing objects, other objects as well as specific construction and improved engine starter will be become apparent and understandable from the following detailed description thereof, when read in conjunction with the accompanying drawing.

DETAILED DESCRIPTION OF THE PREFERRED EMBODIMENTS

An embodiment of the engine starter of the present invention will be described with reference to FIG. 2.

Figure 1:
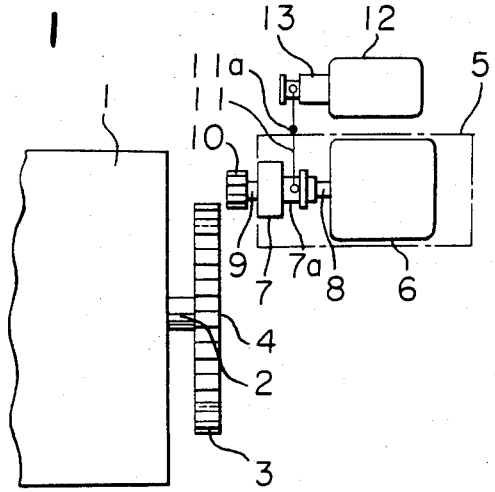
FIGURE 1 PRIOR ART
FIG. 1 is a schematic view showing a construction of the conventional engine starter.
Figure 2:
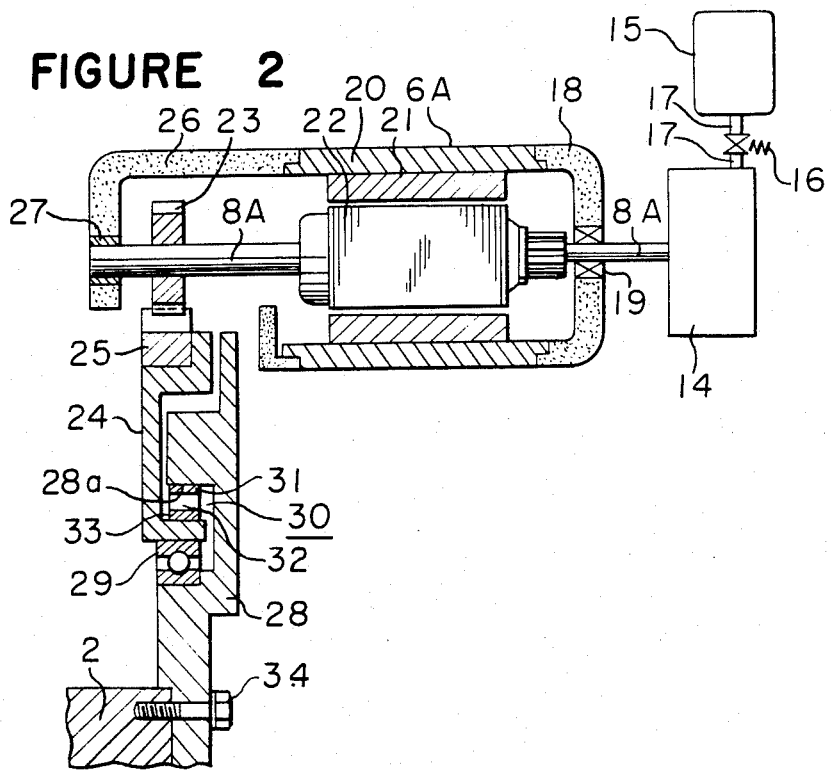
FIG. 2 is a cross sectional view of an embodiment of the engine starter of the present invention.

In FIG. 2, there is shown an air motor 14, for instance, of a volume type which is connected to the rotary shaft 8A of a d.c. motor 6A to be driven. An air tank (air reservoir) 15 is communicated to the air motor 14 through a piping 17, an electromagnetic valve 16 being interposed in the piping 17. A yoke 20 fitted with magnetic field poles 21 at its inner circumferential surface is clamped and secured by a rear frame 18 and a front frame 26. The rear frame 18 is provided with a bearing 19 which rotatably supports the rear end part of the rotary shaft 8A and the front frame 26 is provided with a sleeve bearing 27 which rotatably supports the front end part of the rotary shaft 8A. An armature 22 is secured to the rotary shaft so as to rotate closely facing the magnetic field poles 21. A pinion 23 is secured to the rotary shaft 8A and is usually interlocked with the ring gear 25 attached to the outer periphery of the rotary flange 24. The inner circumferential surface of the rotary flange 24 is supported by a flywheel 28 through a ball bearing 29. The flywheel is constructed in such a manner that a rotational force is transmitted in only one direction with respect to the rotary flange 24 by a rotational force one-way coupling clutch (an overrunning clutch) 30 which is placed coaxial with the rotary flange 24. The flywheel is firmly secured to a crank shaft 2 with a hexagon headed bolt 34. The rotational-force one-way coupling clutch 30 is constituted by a clutch outer part 31, a frictional piece 32 and a clutch inner part 33. The clutch outer part 31 is fitted to a circumferential groove 28*a* of the flywheel 28 and the clutch inner part 33 is fitted to the rotary flange 24 respectively.

The operation of the embodiment having the above-mentioned construction will be described.

When the d.c. motor 6A is fed with electric current from a car battery (not shown) to be actuated, a rotational force produced by the actuation of the motor is transmitted to the engine 1 for starting through the pinion 23, the ring gear 25, the rotary flange 24, the rotational force one-way coupling clutch 30, the flywheel 28 and the crank shaft 2.

After starting of the engine, revolution speed of the flywheel 28 becomes greater than that of the rotary flange 24. In this case, rotational force is not transmitted to the rotary flange 24 by the function of the rotational force one-way coupling clutch 30 and the rotary flange is subjected to non-loaded, free revolution.

When feeding of electric current to the armature 22 of the d.c. motor 6A is switched to be reverse flow, so that the engine 1 is actuated for revolution, the d.c. motor is rotated in the reverse direction to drive the air motor 14 with the consequence that compressed air is filled in the air tank 15 due to the pumping function of the air motor 14 through the electromagnetic valve 16 which has been automatically opened at the time of actuation of the air motor. When pressure in the air tank reaches at a predetermined level, the electric current fed the d.c. motor 6A is stopped and the electromagnetic valve 16 is closed; thus the preparation for next starting of the engine is completed.

The mode of restart of the engine will be described. Opening of the electromagnetic valve 16 actuates the air motor for revolution and at the same time the d.c. motor is actuated by feeding current as described before. The rotary shaft 8A is driven by the composite torque of the air motor 14 and the armature 22 and thus produced rotational force is transmitted to the crank shaft 2 through the pinion 23, the ring gear 25 and so on, with the result that the engine 1 is restarted.

Thus, the operation of the engine starter according to the present invention renders electric current to the d.c. motor small, hence excessive discharge of the car battery (not shown) is prevented to allow its long use. This is practically advantageous. Further, according to the embodiment of the present invention, starting of the engine with compressed air provides a satisfactory starting property even though the environmental temperature is high at the time of restarting the engine immediately after its stoppage. The high temperature environment rather effects advantageously on the device of the present invention in accordance with the Charles' law that pressure of compressed air increases as temperature rises.

At restarting of the engine, it is possible to use simultaneously the d.c. motor 6A and the air motor 14 to reduce the load of the d.c. motor 6A. Further, it is possible to employ an indirect driving system such as a belt driving system or a chain driving system because a relative position of the pinion 23 to the ring gear 25 is fixed with respect to their axial directions.

Compressed air filled in the air tank 15 may be utilized for pneumatic devices mounted on the car and waste gas having been used to start the engine may also be used to cool the engine. As described above, the engine starter of the present invention is so constructed that the air motor is connected to the reversible d.c. motor; the rotary shaft of the d.c. motor is usually interlocked with the ring gear connected to the crank shaft of the engine and the overrunning clutch is placed between the ring gear and the flywheel. Accordingly, the air motor is used as an air pump by making the d.c. motor reversely rotate after the engine has been started whereby compressed air is filled in the air tank by driving the pump so that the compressed air is fed to the air motor to actuate the same at the time of restarting of the engine. As a result, there are excellent practical effects such that at the time of restarting the engine, electric current to be consumed for the d.c. motor can be samll, hence a highly powerful starting device can be obtained and compressed air filled in the air tank can be utilized for other pneumatic devices mounted on the car under a simple construction and in a low cost.

We claim:

1. An engine starter comprising:

a d.c. motor, a pinion secured to one end of a rotary shaft of the d.c. motor, a rotary flange having a ring gear which is always interlocked with the pinion to be driven, a flywheel which is, on one hand, connected to said rotary flange through a rotational force one-way coupling clutch and is, on the other hand, firmly secured to a crank shaft of an engine, an air motor connected to the other end of the rotary shaft of said d.c. motor, an air tank communicated to said air motor through a piping, and an electromagnetic valve interposed in said piping, wherein said rotary flange is provided with said ring gear at an outer circumference thereof and a ball bearing at an inner circumference thereof, wherein said rotary flange is supported by said flywheel through said ball bearing, and wherein said pinion is directly interlocked with said ring gear.

2. An engine starter according to claim 1, wherein said d.c. motor is capable of reverse rotation.

3. An engine starter according to claim 1, wherein said rotational force one-way coupling clutch is constructed in such a manner that the revolution of said rotary flange is solely transmitted to said flywheel.

4. An engine starter according to claim 3, wherein said rotational force one-way coupling clutch is consituted by an clutch outer part, a frictional piece and a clutch inner part, in which said clutch outer part is fitted to said flywheel and said clutch inner part is fitted to said rotary flange.

* * * * *